US008206223B2

(12) United States Patent
Marans et al.

(10) Patent No.: US 8,206,223 B2
(45) Date of Patent: Jun. 26, 2012

(54) COMPUTER FASHION GAME WITH MACHINE-READABLE TRADING CARDS

(75) Inventors: Elaine Marans, Toronto (CA); James Zielinski, Hawthorne, CA (US); Rene M. Pasko, Redondo Beach, CA (US); Kimberly Culmone, West Hollywood, CA (US); Stacey K. Brand, Culver City, CA (US)

(73) Assignee: Mattel, Inc., El Segundo, CA (US)

( * ) Notice: Subject to any disclaimer, the term of this patent is extended or adjusted under 35 U.S.C. 154(b) by 1094 days.

(21) Appl. No.: 12/111,044

(22) Filed: Apr. 28, 2008

(65) Prior Publication Data

US 2009/0011837 A1 Jan. 8, 2009

Related U.S. Application Data

(60) Provisional application No. 60/926,558, filed on Apr. 27, 2007.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/43; 273/85; 273/293; 345/419; 345/422; 345/661; 434/409; 434/410

(58) Field of Classification Search ..... 463/43; 345/419, 422, 661; 273/293, 85; 434/410, 434/409

See application file for complete search history.

(56) References Cited

U.S. PATENT DOCUMENTS

| | | | |
|---|---|---|---|
| 3,391,392 | A | 7/1968 | Doyle |
| 3,534,396 | A | 10/1970 | Hart et al. |
| 3,766,528 | A | 10/1973 | Ichida |
| 3,887,903 | A | 6/1975 | Martell |
| 4,058,849 | A | 11/1977 | Fitzgerald et al. |
| 4,070,710 | A | 1/1978 | Sukonick et al. |
| 4,149,246 | A | 4/1979 | Goldman |
| 4,261,012 | A | 4/1981 | Maloomian |
| 4,539,585 | A | 9/1985 | Spackova et al. |
| 4,546,434 | A | 10/1985 | Gioello |
| 4,724,468 | A | 2/1988 | Bulls |
| 4,729,564 | A | 3/1988 | Kuna et al. |
| 4,777,748 | A | 10/1988 | Ackeret |
| 4,787,162 | A | 11/1988 | Ackeret |

(Continued)

FOREIGN PATENT DOCUMENTS

| | | |
|---|---|---|
| CA | 1 237 528 | 5/1988 |

(Continued)

OTHER PUBLICATIONS

Barbie® Cool Looks Fashion Designer software User Guide, Mattel, Inc., 1997.

(Continued)

*Primary Examiner* — David L Lewis
*Assistant Examiner* — Adetokunbo Torimiro
(74) *Attorney, Agent, or Firm* — Kolisch Hartwell, PC

(57) ABSTRACT

A game system including cards with computer-readable information is provided. The computer-readable information may be in the form of a code embodied on the cards. The cards may be selectively chosen and compiled in a card compiling device that is configured to remove singly a series of cards from one location and to deliver the removed cards to a new location.

20 Claims, 9 Drawing Sheets

Fig. 2

U.S. PATENT DOCUMENTS

| | | | | |
|---|---|---|---|---|
| 4,861,031 | A | 8/1989 | Simms | |
| 4,949,286 | A | 8/1990 | Ohba | |
| 4,993,179 | A | 2/1991 | Ackeret | |
| 5,042,972 | A | 8/1991 | Bach et al. | |
| 5,212,368 | A | 5/1993 | Hara | |
| 5,314,336 | A | 5/1994 | Diamond et al. | |
| 5,341,305 | A | 8/1994 | Clarino et al. | |
| 5,410,958 | A | 5/1995 | Sharpe | |
| 5,411,259 | A | 5/1995 | Pearson et al. | |
| 5,476,407 | A | 12/1995 | Hall, Jr. | |
| 5,625,534 | A | 4/1997 | Okaya et al. | |
| 5,680,528 | A | 10/1997 | Korszun | |
| 5,743,801 | A | 4/1998 | Welander | |
| 5,930,769 | A | 7/1999 | Rose | |
| 5,949,050 | A * | 9/1999 | Fosbenner et al. | 235/449 |
| 5,959,281 | A | 9/1999 | Domiteaux | |
| 6,089,943 | A | 7/2000 | Lo | |
| 6,200,216 | B1 | 3/2001 | Peppel | |
| 6,234,389 | B1 | 5/2001 | Valliani et al. | |
| 6,484,939 | B1 | 11/2002 | Blaeuer | |
| 6,532,314 | B1 | 3/2003 | Plain et al. | |
| 6,612,501 | B1 | 9/2003 | Woll et al. | |
| 6,709,336 | B2 | 3/2004 | Siegel et al. | |
| 6,761,637 | B2 | 7/2004 | Weston et al. | |
| 6,773,351 | B2 | 8/2004 | Brown | |
| 6,800,013 | B2 | 10/2004 | Liu | |
| 6,905,391 | B2 | 6/2005 | Soto et al. | |
| 6,967,566 | B2 | 11/2005 | Weston et al. | |
| 7,033,243 | B2 | 4/2006 | Hornsby et al. | |
| 7,081,033 | B1 | 7/2006 | Mawle et al. | |
| 7,118,482 | B2 | 10/2006 | Ishihara et al. | |
| 7,147,561 | B2 | 12/2006 | Takeuchi | |
| 7,164,419 | B2 * | 1/2007 | Hill et al. | 345/419 |
| 2002/0022506 | A1 | 2/2002 | Rifkin | |
| 2002/0052238 | A1 | 5/2002 | Muroi | |
| 2002/0077182 | A1 | 6/2002 | Swanberg et al. | |
| 2002/0155893 | A1 | 10/2002 | Swanberg et al. | |
| 2002/0178061 | A1 | 11/2002 | Lam | |
| 2003/0016844 | A1 | 1/2003 | Numaoka | |
| 2003/0064812 | A1 | 4/2003 | Rappaport et al. | |
| 2003/0096652 | A1 | 5/2003 | Siegel et al. | |
| 2003/0155714 | A1 | 8/2003 | Higashida | |
| 2003/0220144 | A1 | 11/2003 | Brown | |
| 2003/0227136 | A1 | 12/2003 | Denkewicz et al. | |
| 2004/0002387 | A1 * | 1/2004 | Grady | 463/43 |
| 2004/0026915 | A1 * | 2/2004 | Thompson et al. | 283/51 |
| 2004/0166913 | A1 | 8/2004 | Shinoda | |
| 2004/0214642 | A1 | 10/2004 | Beck | |
| 2005/0009610 | A1 | 1/2005 | Miyamoto et al. | |
| 2005/0052238 | A1 | 3/2005 | Vollrath et al. | |
| 2005/0059317 | A1 | 3/2005 | McEachen et al. | |
| 2005/0070204 | A1 | 3/2005 | McEachen et al. | |
| 2005/0182693 | A1 | 8/2005 | Alivandi et al. | |
| 2006/0030410 | A1 | 2/2006 | Stenton et al. | |
| 2006/0031119 | A1 | 2/2006 | Sellen et al. | |
| 2006/0040746 | A1 | 2/2006 | Eguchi et al. | |
| 2006/0054679 | A1 | 3/2006 | Ruping | |

FOREIGN PATENT DOCUMENTS

| | | |
|---|---|---|
| EP | 0 205 683 | 4/1990 |
| EP | 0 529 596 A1 | 3/1993 |
| JP | 2003-047771 | 2/2003 |
| WO | 9728867 | 8/1997 |
| WO | 0146911 | 6/2001 |
| WO | 0148580 | 7/2001 |
| WO | 0247013 | 6/2002 |
| WO | 03043709 | 5/2003 |
| WO | 03057328 | 7/2003 |
| WO | 2006036851 | 4/2006 |
| WO | 2006038905 | 4/2006 |

OTHER PUBLICATIONS

Barbie® Fashion Designer software User Guide, Mattel, Inc., 1996.

The American Girls Dress Designer software outer packaging, Pleasant Company, 1999.

Young, Lee W., Authorized officer, International Searching Authority, International Search Report, International Application Serial No. PCT/US2008/061810; search date: Aug. 20, 2008.

Young, Lee W., Authorized officer, International Searching Authority, Written Opinion of the International Searching Authority, International Application Serial No. PCT/US2008/061810; completion date: Aug. 20, 2008.

International Search Report and Written Opinion for Application No. PCT/US2008/061810.

* cited by examiner

COMPUTER FASHION GAME WITH MACHINE-READABLE TRADING CARDS

CROSS-REFERENCE TO RELATED APPLICATIONS

This application claims priority under 35 U.S.C. 119(e) to U.S. Provisional Patent Application No. 60/926,558 entitled "COMPUTER FASHION GAME WITH MACHINE READABLE TRADING CARDS," filed Apr. 27, 2007, the disclosure of which is incorporated herein by reference.

BACKGROUND

Children enjoy a variety of imaginative play activities that incorporate models and characters that may be manipulated to simulate real life activities. Children also typically prefer to play games that have several play options, and may be played in many different ways. It is therefore desirable to provide children with toys and games that both simulate activities the children are not yet able to participate in themselves while stimulating their imaginations with several play options. One way of increasing the available play options is to provide toys and games with multiple elements that may be combined in many ways. With today's increasingly technologically savvy children, it is also possible to increase playtime enjoyment by coordinating physical play items with computer-implemented games and game themes.

The present disclosure is directed to a computer-implemented fashion game configured to interact with machine readable, combinable trading cards, to incorporate computer-readable card information within the computer game. Examples of computer games interacting with machine-readable cards, and of interactive fashion computer systems include those disclosed and described in: U.S. Pat. Nos. 7,081,033, 6,967,566, 6,761,637, 6,709,336, 6,612,501, 6,200,216, 5,680,528, 4,546,434, U.S. Patent Application Publication Nos. US20060031119, US20050052238, US20040166913, US20040002387, US20030016844, US20020022506, and US20020178061; and PCT Publication Nos. WO0148580, WO0146911, WO0247013, WO03057328, WO03043709, and WO2006038905. Exemplary card holders and photo organizers are disclosed and described in U.S. Pat. Nos. 4,777,748, 4,787,162, and 4,993,179. The complete disclosures of the above patents and patent application publications are herein incorporated by reference for all purposes.

SUMMARY

The present disclosure relates generally to computer-readable trading cards. More specifically, it relates to computer-readable trading cards whose encoded information is displayed and manipulated in a computer-based play activity. As well, the present disclosure describes a card compiler or organizer configured to allow a user to progress through a compilation of cards and select individual cards or sets of cards for use in the computer game.

DETAILED DESCRIPTION

Figure 1:
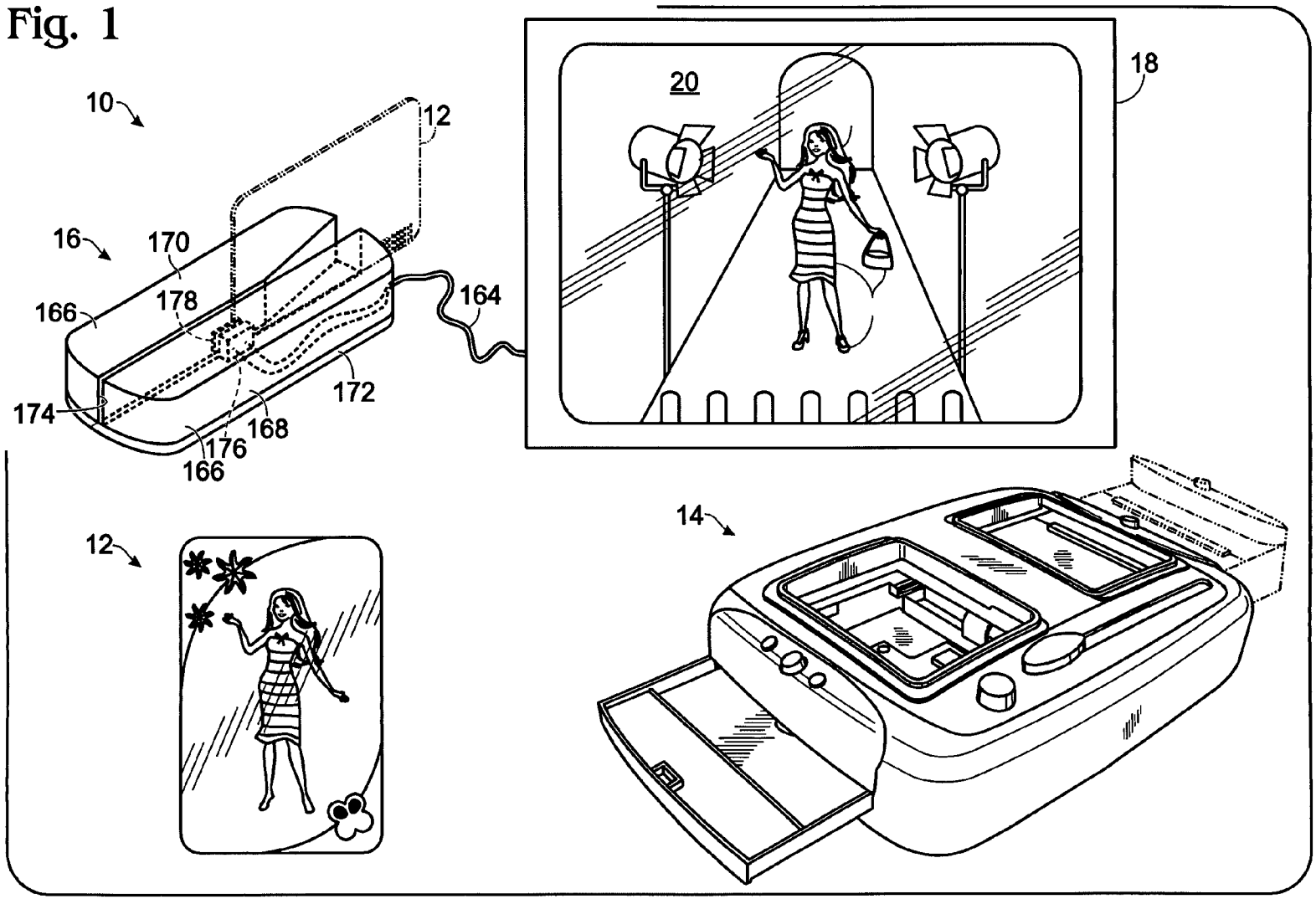
FIG. 1 introduces a number of components of an embodiment of a game system including machine-readable trading cards.

FIG. 1 shows a number of components of an embodiment of a game system 10, including a machine-readable game card 12, a mechanical card compiler 14, and an electronic card scanner 16 connected to a computer system 18. Computer system 18 is represented in FIG. 1 as a simple tablet-style, touch screen computer 18, but other electronic display systems may be used, such as desktop and laptop computers with various input devices such as a mouse, touchpad, keyboard, camera, and/or microphone. Other types of computers include personal digital assistants (PDA), pocket PCs, cell phones, and dedicated electronic displays, either in the singular, operated by a single user, or in the plural, operated by multiple distributed users as part of a networked system of computers linked by a communication medium, such as the Internet.

Figure 2:
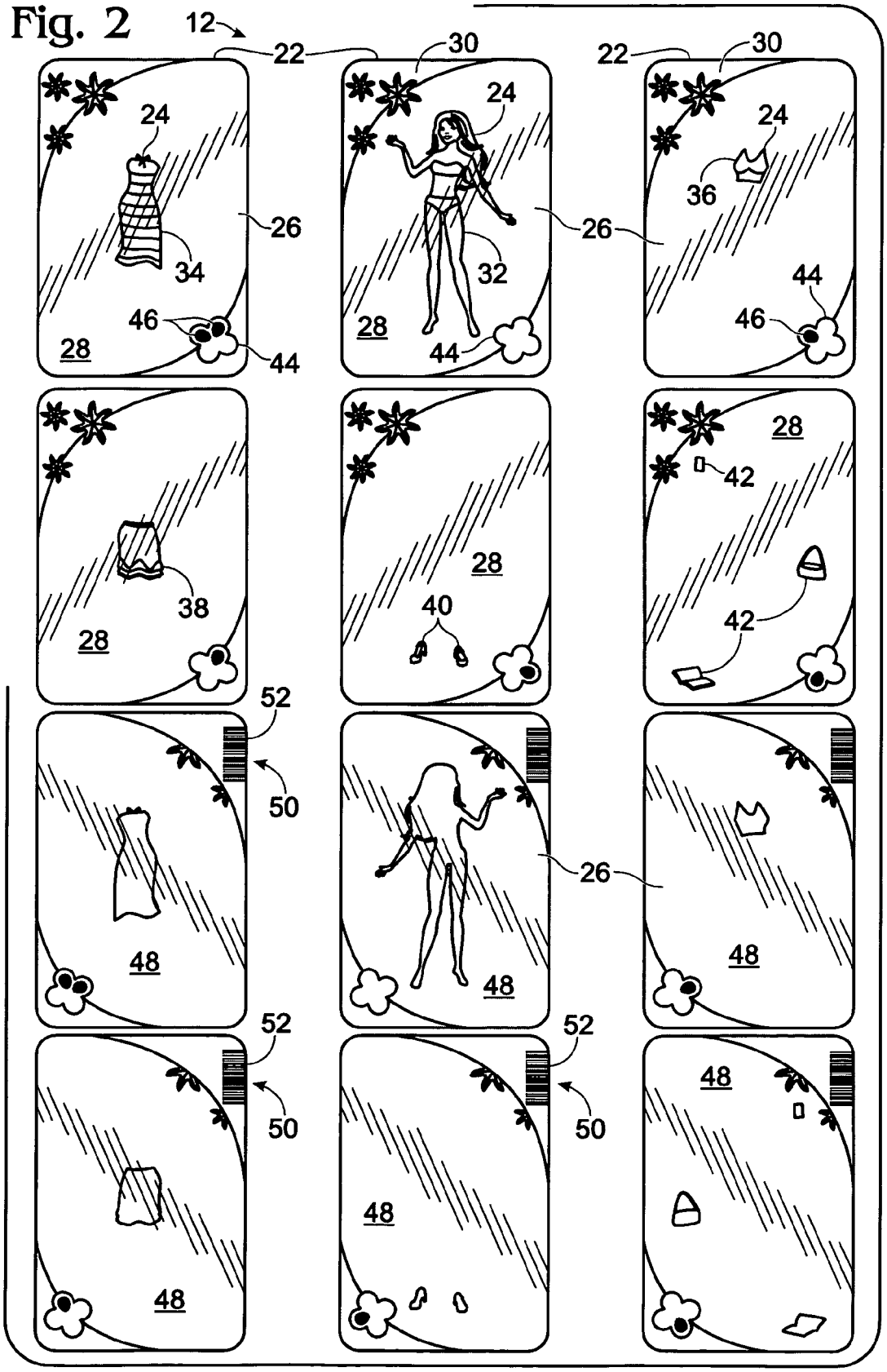
FIG. 2 shows a number of embodiments of machine-readable trading cards for use with the game system of FIG. 1.

FIG. 2 shows a number of embodiments of machine-readable game cards 12 for use with the game system 10 of FIG. 1. Each game card 22 may include an opaque design component 24 included on an otherwise transparent card body portion 26. Typically, the opaque design component 24 will be placed on a front surface 28 of the game card, perhaps in addition to a decorative border 30.

The opaque design components embody elements of a fashion game, and may be configured as portions of a fashion scene. For example, the opaque design components could take the form of a mannequin, or body, 32, a full-body dress 34, a clothing top 36, a clothing bottom 38, a pair of shoes or other footwear 40, and one or more accessories 42. By having opaque design components on a transparent background, the cards may be used to form a complete fashion ensemble by layering them one atop the other. Tomy and/or Takara of Japan market this general type of transparent, color-coded fashion overlay cards under the names "Mille Feuille" and/or "Kirarin," and similar disclosures are found in WO03057328.

As illustrated in the lower left corner of FIG. 1, body form 32 may be in the lower-most position in a deck of cards. On top of that lowermost card may be a card having full-body dress 34. Because the cards may have transparent body portions 26 with opaque design components 24, body form 32 on the lower card may easily be seen when the two cards are layered, and dress 34 clothes body form 32, when viewed from above.

Alternatively, other combinations may be assembled, and the order of elements may be varied within the stacked cards. For example, to continue building up a fashion ensemble, a game player may progressively layer cards having shoes 40, a top 36, a bottom 38, and/or a number of accessories, 42, such as a computer and a handbag. Again, because the cards include opaque components printed or otherwise embodied on a transparent card body, layering them one atop another will allow the opaque portion of any one card to be seen from above the stack of layered cards (unless, of course, two cards from the same class of cards are used; for example, layering two cards having tops 36 might allow only the component of the uppermost card to be seen). As well, since the game cards are primarily composed of a transparent card body 26, it may be possible to see the opaque design component 24 from the back surface of the card.

Card border 30 might be any color or design that makes for an attractive game card and it may or may not include game information in its design. For example, a portion of the border 30 might be a combination code element 44 having multiple combination code portions 46. The combination code element 44 might take, for example, the form of a shamrock or other image having multiple portions. In this manner, the combination code could be used to signify which cards may be used to form a cohesive set or fashion ensemble.

As seen in FIG. 2, a complete ensemble might be constructed by combining together a mannequin or body FIG. 32 with no combination code portions, and a number of other elements (perhaps four elements), each having a different single combination code portion, such that a full complement of the combination codes is present in the finished ensemble. If the combination code element has quadrants, then each fashion component may include a symbol that fills one quadrant of the combination code element, such that the complete ensemble has portions that occupy all four quadrants of the combination code element.

The back surface of each card may include a design code 50, such as barcode 52. The design code 50 may be unique for each opaque design component on the front of the card. On the other hand, the design code 50 might be unique for each class of opaque design components. In the embodiment shown, each design code 50 is unique for each opaque design component 24.

Typically, the design code 50 will be placed on a portion of the card such that it is backed by an opaque design component. In this way, a design code 50 that is embodied as a barcode 52 will have a solid-colored background, making it easier to scan by card scanner 16. Because the design code 50 may be scanned by a computing system, it may be thought of as machine-readable information for each card.

Figure 3:
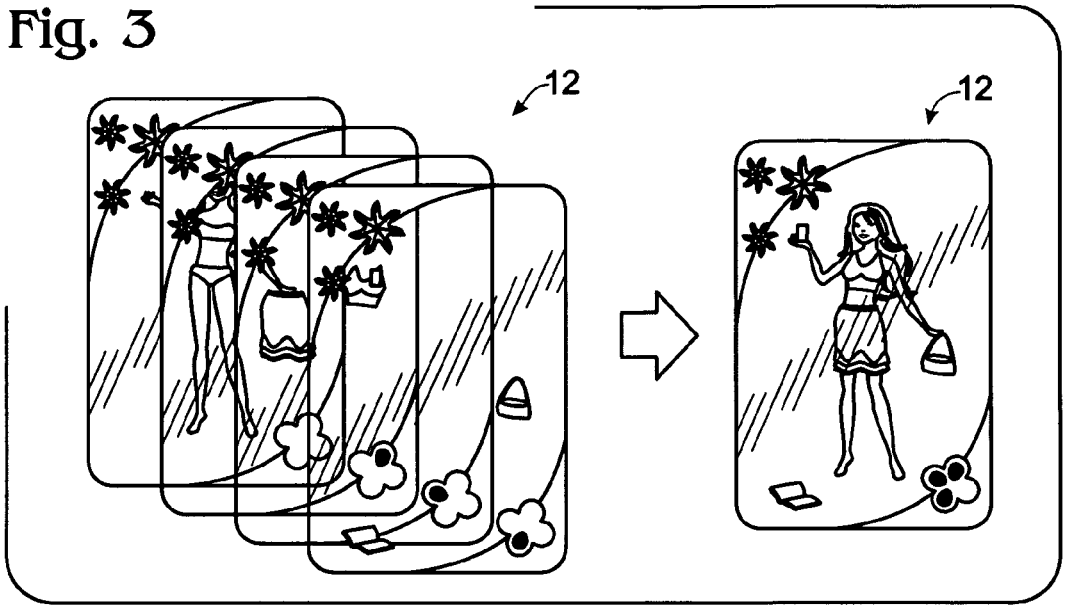
FIG. 3 shows a layering of a number of cards of FIG. 2.

FIG. 3 shows that a number of transparent cards 12 may be layered to produce a complete fashion ensemble. Cards 22, each individually including at least one of a model body 32, a top 36, a bottom 38, and/or an accessory 42, may be layered to produce a complete image. On the left portion of FIG. 3, cards 22 are shown layered in an offset manner to demonstrate that the cards may be layered one atop the other. On the right portion of FIG. 3, cards 22 are shown layered in register, to demonstrate that the opaque component of each card may be seen when the stack is viewed from the top. Thus, when viewed from the top, and in register, a model body may appear to be presented with the clothing and accessories chosen by a user of the cards, for a given stacking order of the cards.

Figure 4:
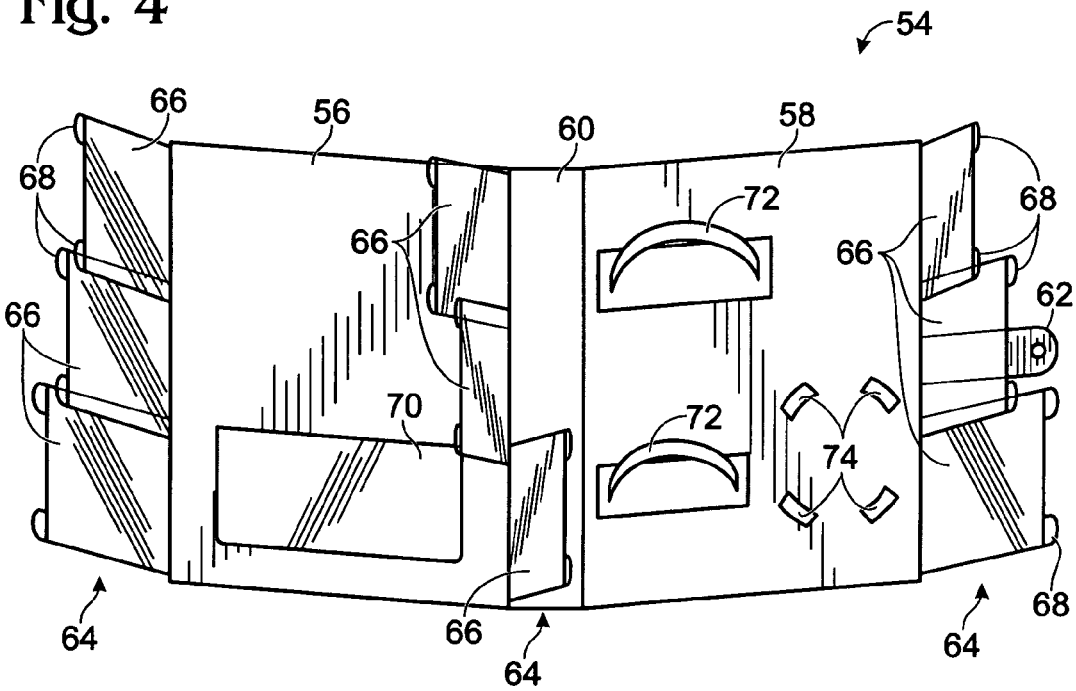
FIG. 4 shows a carrying case for carrying components of the game system of FIG. 1.

FIG. 4 shows a carrying case 54 for carrying or holding the various elements useful in playing with the game system 10 of FIG. 1. Carrying case 54 may take a book-like form, where the case has a first cover 56 and a second cover 58 extending from a central spine 60. The covers may be in an open or extended configuration, or the carrying case may be held closed with a strap 62 that may be configured as a hook-and-loop closure system or any other appropriate closure system.

Carrying case 54 may include a number of "pages" 64 including a number of card pockets 66. Each card pocket may include a pocket tab 68 useful for manipulating the position of the card pocket (i.e. turning the pocket "page"). Each card pocket may be single-layered, or a card pocket 66 may be multi-layered, with each card pocket layer having an associated tab 68, such that multiple sets of cards may be stored at the same level of a given page (as in the drawing).

Carrying case 54 may also include a pocket 70 useful for holding a CD, DVD, or other media on which game software may be stored. In the illustrated embodiment, the pocket is broad and thin so that it may contain a CD, DVD, or other thin media. In other embodiments, the pocket may be sized for a different type of media.

Carrying case 54 may also include one or more straps or restraints 72 to hold securely a card scanner. In the illustrated embodiment, the straps 72 are of elastic construction so that they may hold securely a scanner and its associated USB cord even if the scanner and cord are wrapped loosely, are not wrapped, or are wrapped tightly.

Finally, carrying case 54 may include a number of card straps 74 suitable for holding a deck of cards that are not otherwise secured in the carrying case (i.e. not placed in card pockets 66 or another convenient location).

Figure 5:
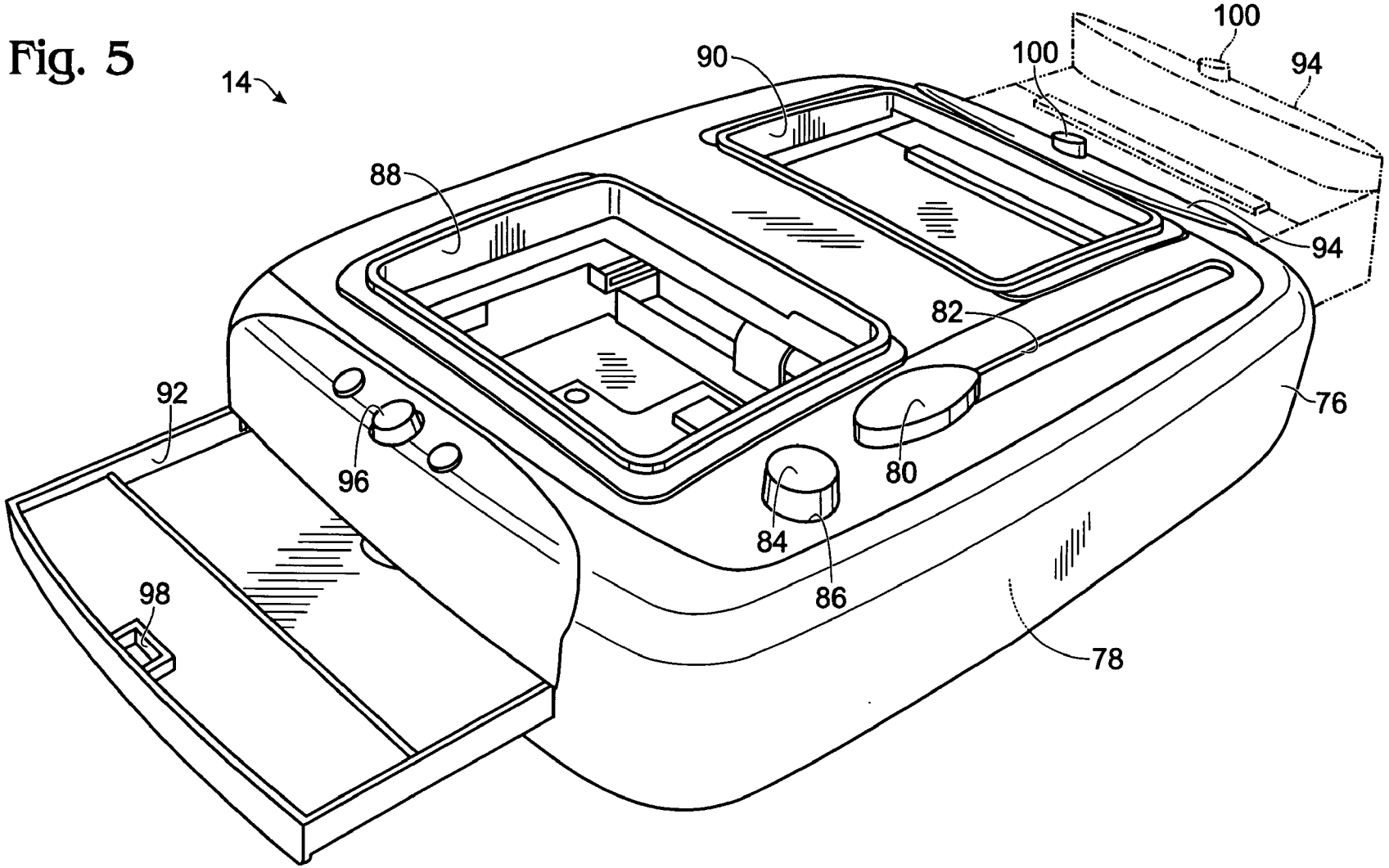
FIG. 5 shows an embodiment of a card compiler suitable for use with a deck of cards, including a deck of the cards of FIG. 2.

FIG. 5 shows an embodiment of a card compiler 14 suitable for use with a deck of cards 12, including a deck of the cards of FIG. 2. Card compiler 14 may include a body having a top shell 76 and a bottom plate 78. The top shell may include a slider knob 80 that rides in a slider slot 82.

Top shell 76 may include a release button 84 that moves in a button hole 86. Slider knob 80 and release button 84, as described below, may be used to move and place cards 12 held in the card compiler. For example, an individual card 22 may be viewed through a left window 88, and then slid to be stored adjacent a right window 90. If desired, release button 84 may allow a user of card compiler 14 to drop a particular card 22 into a small tray 92, beneath window 88. Alternatively, slider knob 80 may allow a user to slide the card into the region beneath right window 90, where the card is automatically released and stored in a large tray 94. Dropping several cards sequentially into small tray 92 allows combinations of cards 22 to be viewed.

Small tray 92 may be associated with a release button 96 on shell 76. Small tray 92 may include a catch hole 98, which may cooperate with button 96 to keep the small tray in the card compiler body. Large tray 94 may include another release button 100. Of course, other locations for the release buttons may be used and other release mechanisms may be used. Because the small tray and the large tray are reversibly couplable to the body of the card compiler, these trays may be considered frame portions of the card compiler.

Figure 6:
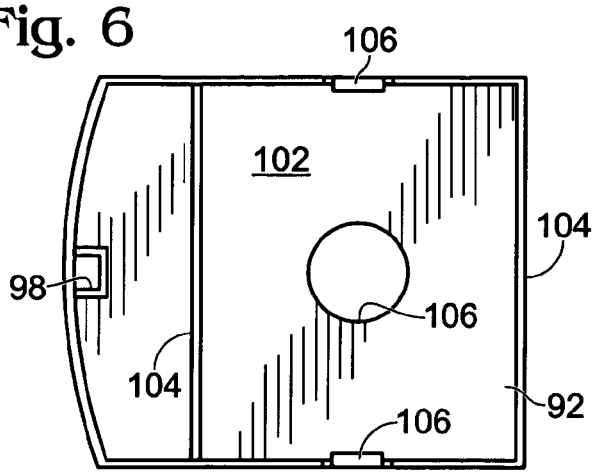
FIG. 6 is a view of a portion of the card compiler of FIG. 5.

FIG. 6 shows details of small tray 92 of the card compiler of FIG. 5. Small tray 92 may include a tray base 102 surrounded by a number of border walls 104. Some of the border walls 104 may include release tabs 106.

Release tabs 106 may be useful in retaining a set of collected cards in the small tray when it is removed from the card compiler body. To remove collected cards from the small tray 92, a user may insert a finger or another object from the backside of tray 92 through the access hole 106. Doing so may cause one or more collected cards to be pushed upwards past release tabs 106, allowing the cards to be removed from small tray 92.

Figure 7:
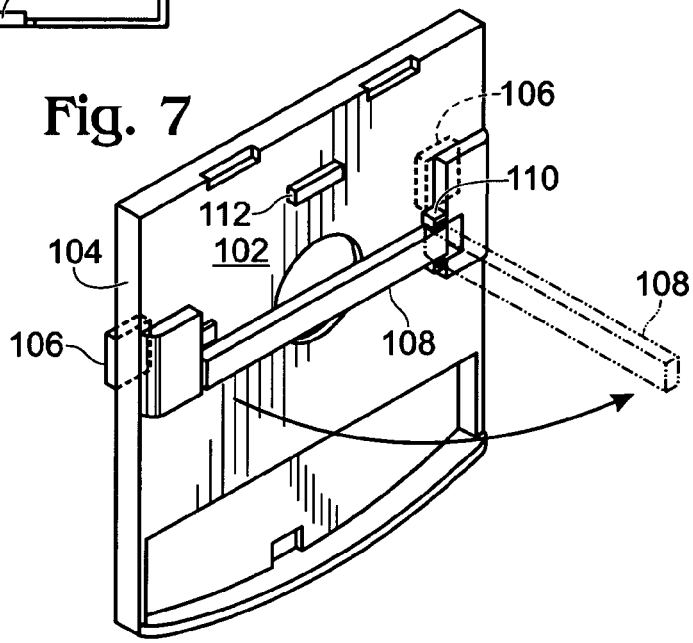
FIG. 7 is another view of the portion of FIG. 6.

FIG. 7 is another view of small tray 92 of FIG. 6. As may be seen in FIG. 7, small tray 92 may include a support leg 108.

Support leg 108 may allow small tray 92 to be used as a display case for a set of collected cards. To use the small tray as a display case for a set of collected cards, a user may swing support leg 108 away from the small tray body 92 at a pivot 110. If pivot 110 includes a relatively tight friction fitting with support leg 108, the support leg may be retained in a given position so that small tray 92 may be supported in an upright manner.

Also seen in this drawing is a guide tab 112, which guides the small tray 92 as it is placed into the card compiler body, and which may contact a spring-loaded portion (128, in FIG. 9) of the card compiler body, providing a force to eject the small tray when release button 96 is depressed.

Figure 8:
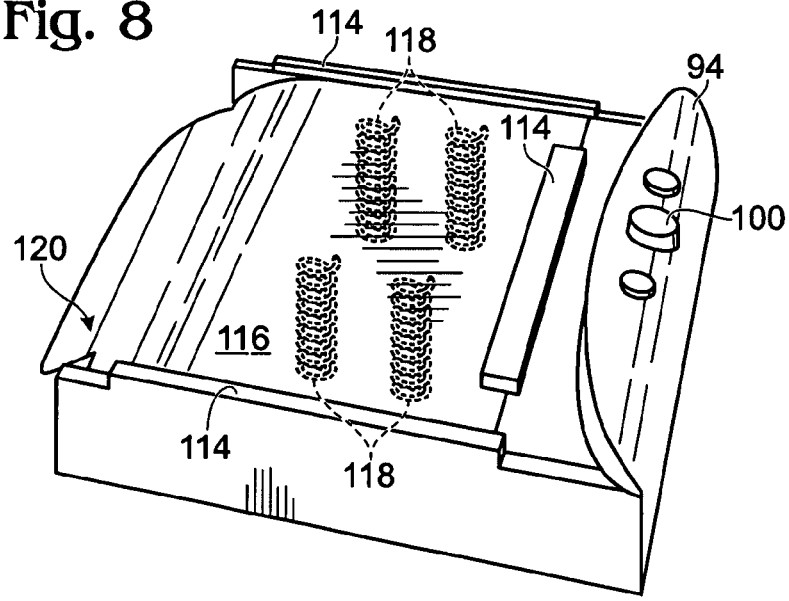
FIG. 8 is a view of another portion of the card compiler of FIG. 5.

FIG. 8 is a view of the large tray of the card compiler of FIG. 5. Unlike the small tray, large tray 94 may include an integral release button 100 that may facilitate the release of the large tray from the card compiler shell. Like the small tray, large tray 94 may include a number of border walls; here, border walls 114. The border walls of the large tray may be deeper than the walls of the small tray because the large tray may be holding a large collection of cards (for example, a deck of cards) rather than the smaller selection of cards usually held in the small tray.

The large tray may also include an adjustable carry plate 116, supported by a number of springs 118, so that the large tray may accommodate a deck of cards of variable thickness. The carry plate may include a lower flange, or downward-angled portion 120. The downward-angled portion may be configured on the carry plate such that it is presented toward the center of the card compiler, placing it in a position where it may receive a card destined for the bottom of a deck held in the large tray (as described below).

Figure 9:
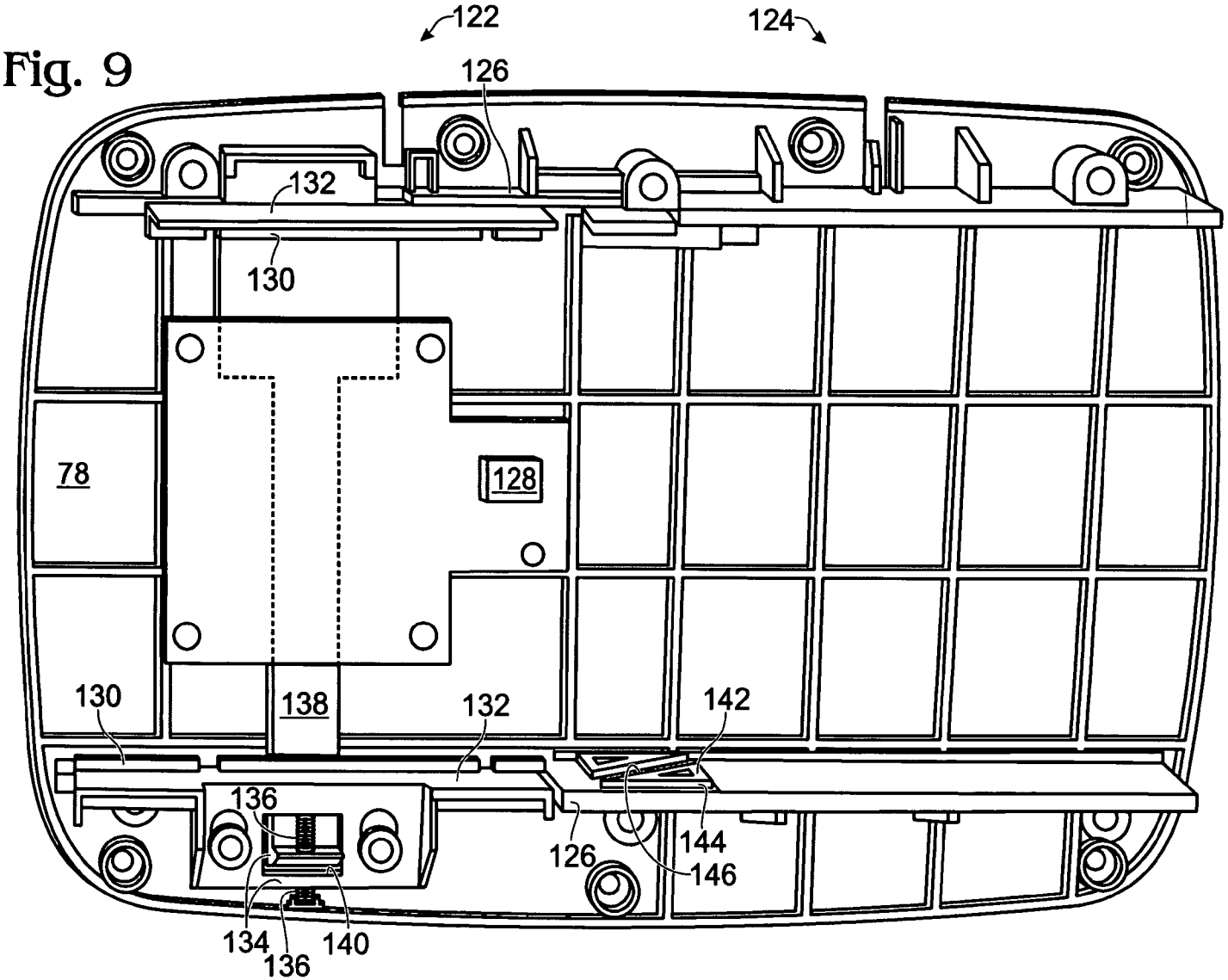
FIG. 9 is an internal view of a portion of the card compiler of FIG. 5.

FIG. 9 is an internal view of a bottom plate 78 of the card compiler of FIG. 5 and its associated structures for compiling a subset of cards from a beginning deck of cards. Near the outer edges of the bottom plate there may be a pair of guide bars 126, providing support for, and guidance to, movement of trays between the left half 122 and the right half 124 of the card compiler.

On the bottom surface of the plate there may be included a retainer element 128. The retainer element may be spring-loaded (with the spring not shown) so that the retainer element may provide snug contact with a tray 92 (or tray 94) inserted into the card compiler. If the retainer element is spring loaded in the direction of insertion of a card tray, then retainer element 128 may also provide in initial propulsive force to assist in removal of the subject tray from the card compiler when a release button for the tray is pushed.

Card shelves 130 may be present on either side of the card compiler and may be coupled to the guide bars 126. In the illustrated embodiment, card shelves 130 are coupled to support plates 132, which in turn are coupled to spring-loaded forcing tabs 134, to which reversible force is applied by springs 136. For example, one support plate 132 may be coupled across the bottom of plate 78 to its forcing tab 134 by a connective structure 138.

Because support plates 132 are spring loaded at forcing tabs 134, they may be reversibly moved apart. Initially, the forcing tabs 134 of a pair of support plates 132 will be forced closer together by their associated springs, causing the interface between the forcing tabs to form a slot 140, and (since coupled to the support plates) a relatively close positioning of the card shelves 130. Typically, card shelves 130, in this configuration, will be slightly closer together than the dimensions of a card that they are supporting.

When a user depresses release button 84 on an upper surface of the card compiler, the release button may actuate an insertion tab 160 (shown in FIG. 10), which moves into slot 140. Because the insertion tab is relatively larger than the slot, and because the forcing tabs forming the slot are spring-loaded, the insertion tab 160 will force the tabs (and, thus, the card shelves, to which the release tabs are coupled) relatively farther apart.

In this configuration, the card shelves may be slightly farther apart than the dimensions of a supported card, allowing the card to drop down from the card shelves 130 into a waiting small tray 92 by the force of gravity; this transfers the card from the moving frame to the small tray (or from one frame portion to another). Insertion tab 160 may be spring-biased away from slot 140 by a spring 161, allowing the shelves to normally be in a relatively closed configuration.

As seen in FIG. 9, the sides of floor 78 and card compiler 14 may be arbitrarily designated the left half 122 and the right half 124. As noted above, a deck of cards may be stored in a large tray on the right side 124 of the card compiler and moved singly (by a mechanism described below) to a small tray residing on the left side 122 of the card compiler. In the illustrated embodiment, director element 142 plays a role in assuring that cards are removed from the top of a deck of cards on the right half 124 of the card compiler but then placed, if not selected for the small tray on the left half 122 of the card compiler, at the bottom of the card deck when moved back to the large tray.

For instance, when a card is coming from the top of a deck of cards in a large tray in the right half 124 of the card compiler, the card will travel over horizontal director section 144 of the director. After passing over the horizontal director section 144, the card will reach the card shelves 130 of support plates 132. Because the horizontal director section 144 in the embodiment shown is slightly above card shelves 130, the moved card will drop down slightly onto the card shelves when its trailing edge passes the terminus of the horizontal director section 144. At this point, release button 84 may be depressed, forcing downward insertion tab 160, spacing apart forcing tabs 134, spacing apart card shelves 130, and dropping the selected card into a small tray 92 at the left half 122.

Alternatively, a user may not desire to keep the moved card and may desire to return it to the card deck so that a new card may be moved and inspected. In this case, the card will be slid back toward the right half 124 of the card compiler. However, because the card is at a slightly lower position that that occupied by horizontal director section 144, it may instead impact a leading edge of an angled director section 146. Angled director section 146, as its name suggests, is placed such that it may direct a non-selected card from a relatively higher position, such as at card shelves 130, to a lower position, such as the bottom of a deck of cards in a large tray at right half 124, when the card is moved from the left to the right half of the card compiler. In this manner, the deck of cards may be circularly rearranged by selective movement of cards from the right half 124 of the card compiler to the left half 122 of the card compiler, and back again. In the described embodiment, the deck of cards may be circularly rearranged from top to bottom (i.e. a card is removed from the top of the deck and replaced at the bottom of the deck).

Figure 10:
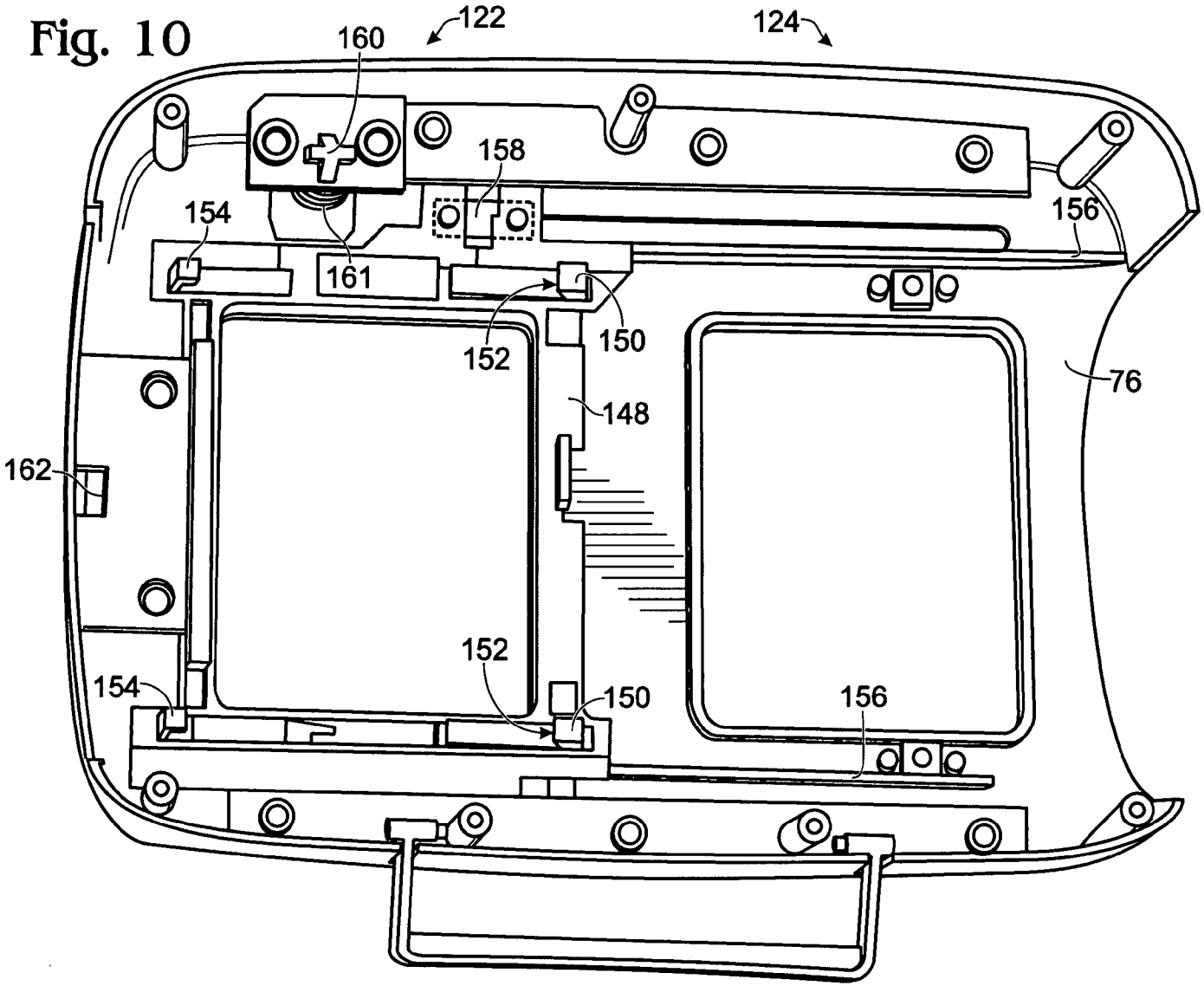
FIG. 10 is an internal view of another portion of the card compiler of FIG. 5.

FIG. 10 is an internal view of a top shell portion 76 of the card compiler 14 of FIG. 5. As discussed above, a card may be picked singly from a deck of cards at one position in the card compiler, moved to another location for inspection and potential selection, and returned to the deck of cards if not selected. In the described embodiment, the top shell 76 may include features suitable for selecting singly the cards to be inspected and potentially selected.

Top shell 76 may include a moving frame 148 suitable for removing a single card from one part of a deck of cards and replacing it at a different location in the deck of cards. Moving frame 148 may include one or more picking arms 150, each having a capture edge 152 that is approximately the depth of a card to be removed from a deck of cards. The picking arm 150 may be spring-biased (by a spring not shown in the drawing) such that it is maintained in frictional contact with a card to be removed from a deck of cards when the moving frame is being used to remove the card.

In the illustrated embodiment, picking arm 150 may be pushed down upon a top card of a deck of cards so that the top card may be slid off the deck of cards and moved to a different location in the card compiler. Moving frame 148, in concert with picking arm 150, may remove the top card from a deck of cards in the right half 124 of the card compiler and move the card to the left half 122 of the card compiler. If the card is not selected, it will be readied for movement back to the right half 124 of the compiler by residing on card shelves 130 such that the leading edge of the card is near the leading edge of the angled director section 146 of director element 142.

To move the card along the downward-angled portion of the angled director section 146, the moving frame 150 may include one or more push arms 154. The push arms may engage a trailing edge of the card to be moved from the left half 122 to the right half 124 of the card compiler, such that when the moving frame is moved in a rightward direction, push arms 154 push the card ahead of them and the card moves downward (guided by the angled director section 146).

Finally, top shell 76 may include tab 162 which may cooperate with small tray 92 to keep the small tray in the card compiler body. Tab 162 may be coupled to button 96. In a default configuration, tab 162 may insert into catch hole 98, retaining the tray in the card compiler. When button 96 is depressed or otherwise manipulated, tab may be moved out of coupling with catch hole 98, allowing removal of small tray 92 to be initiated. Small tray 92 may be removed entirely manually, or its removal may be initiated by spring-loaded retainer 128.

In the illustrated embodiment, large tray 94 is configured such that the bottom of a large deck of cards is relatively close to the lower edge of angled director section 146 (because of the accommodating, spring-loaded nature of plate 116) and, thus, a card passing along the angled director section 146 will be transferred to the bottom of the nearby deck of cards. Close inspection of plate 116 of FIG. 8 shows that, if the deck of cards is not very large, a card being pushed by push arms 154 will engage a downward-angled portion 120 of plate 116 and then be guided up to the bottom of the deck of cards residing on that plate.

As shown in FIG. 10, slider knob 80 (which is accessible from the outside upper surface of top shell 76) may be coupled to moving frame 148 via a coupling structure 158. As noted above, the moving frame is passed reversibly from one side of the card compiler to another as a user removes a card from the deck of cards and then inspects the card and either keeps it in the small tray or returns it to the large tray. Slider knob 80 may allow a user to facilitate reversible movement of moving frame 148 on one or more rails 156 by sliding knob 80 back and forth in slot 82. In this manner, moving frame 148 may be moved in a stable, smooth, reversible manner from one location to another within card compiler 14.

Returning to FIG. 1, the game system may include a card scanner 16 for reading machine-readable information from the cards 12 of FIG. 2, with one of those cards shown in shadow. A card scanner 16 may be connected to a computing system 18 by a USB connection cord 164.

The card scanner body may include top portions 166 mounted on a bottom plate 172. In the embodiment shown, top portions 166 are embodied as first and second top halves 168 and 170. Close placement of halves 168 and 170 may form a slot 174, into which a card 22 may be placed.

One half 168 of the card scanner might include electronics for reading a barcode 52 embodiment of a design code on a back surface of a card 22. The electronics might include an LED 176 that may be configured to scan a barcode 52 slid between the LED and a background panel 178 in another half of the scanner body.

Thus, to read a barcode 52 embodiment of a design code 50 on a card 22, the card may be run through the slot 174, past the LED 176. Simultaneously, the background plate 178 may provide a good background for reading the design code 50 if it is a barcode 52. Machine-readable information in the barcode 52 may then be sent through the USB connection cord 164 to a computing system 18 for use in further game play. Although discussed as providing for the scanning of a barcode 288 design code, it is clear that other scanning element/information code combinations may be used to similar effect (for example, an RFID reader and an RFID chip could be used, among other possibilities).

Figure 11:
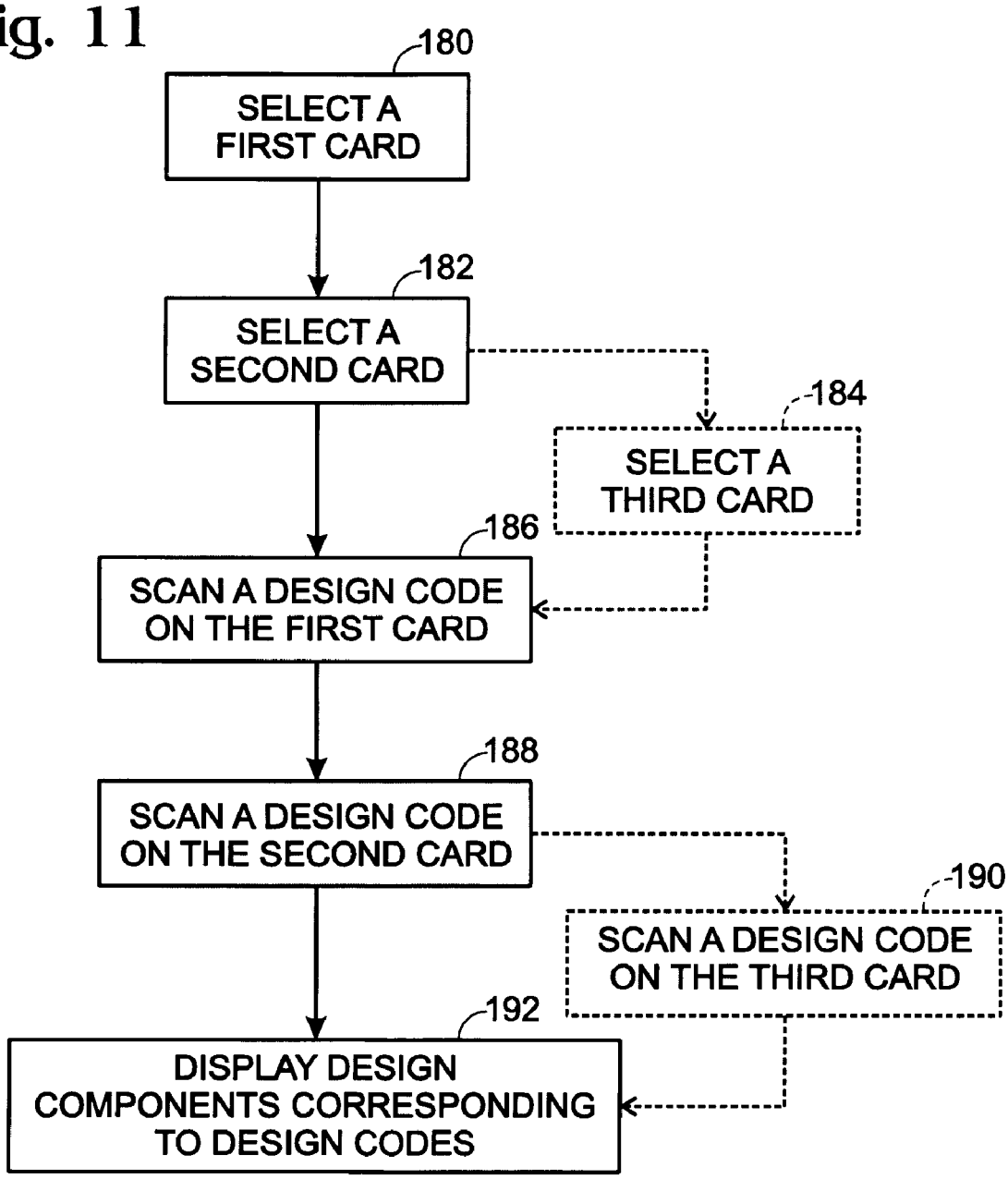
FIG. 11 shows exemplary steps of a play pattern utilizing the game system of FIG. 1.

FIG. 11 shows exemplary steps of a play pattern utilizing the game system of FIG. 1. At step 180, a user may select a first card 22 for use in making a combination of cards. To accomplish this step, a user may first place a deck of cards in a large tray 94 below right window 90 by first removing the tray from the card compiler, depressing the spring-loaded plate 116 in the large tray 94, placing the deck of cards in the large tray, and reinserting the large tray into the card compiler.

The user may then slide the slider knob 80 so that it moves an associated moving frame 148 such that a picking arm 150 on the moving frame is coupled to a single card in the deck of cards in the large tray. The user may then slide the slider knob 80 to the left, bringing the associated moving frame 148 to a location in the left window 88, such that the card picked from the deck of cards by the picking arm is now above the small tray 92. Because the single card moves over the director element 142, it may drop down onto card shelves 130.

If the user desires to retain, or select, the card in the small tray 92, the user may then push release button 84 to drop the card from the card shelves 130 into the small tray 92. If the user does not desire to select the card taken from the deck of cards, the user may slide the knob 80 back toward the right window.

Sliding a card from left to right will cause the card to be pushed by the push arms 154 of the moving frame 148, and to impact upon the angled director section 146 of the director element 142. Because the angled director section 146 is angled downward toward the bottom of the deck of cards held in large tray 94, the non-selected card will be placed at the bottom of the deck of cards in the large tray below window 90.

A user may repeat this selecting step 180 as many times as desired and, thus, progressively remove cards from a deck of cards in the right window and place them in the small tray underneath the left window or at the bottom of the original deck of cards (resulting in a circular rearrangement of that deck). For example, the user may select a second card 182 using this process, select a third card 184 using this process, and so on.

If a user begins with a mannequin or body card, placing it as the first card in the small tray 92, the user may then progressively build up a fashion ensemble in the left window by removing cards from the large tray on the right and placing them in the small tray on the left; because the main body of each card is transparent, the compatible elements of a fashion ensemble may all be seen when the cards are layered.

Once a card or cards of a fashion ensemble is selected, the user may commence scanning 186 the information from the card into a computer, so that the information on the card may be used in a computer-implemented fashion game. To get card information into a computer, the user may take a selected card 22 and insert it or otherwise seat it in a slot 174 on a card scanner 16. The user may then slide the selected card 22 through the slot, passing the card so that the design code 50 on the card (for example, barcode 52) is exposed to a scanning element (e.g., LED 176) in the card scanner.

In the illustrated embodiment, the barcode 52 is moved between an LED 176 and a background panel 178 so that the card scanner may read the barcode effectively. In this way, a user scans the design code 186 on the first card chosen. If the user desires to select more cards and input the cards' information into a computer system associated with the card scanner, the user may scan a design code on a second card 188, scan a design code on a third card 190, and so on.

Finally, a computer 18 or system of computers 18 may utilize the input from the design codes 50 of the selected cards 22 in displaying 192 the computer-based design components on a display associated with the computer; the displayed components may correspond to the card-based opaque design components 24 associated with each design code 50 that was input to the computer.

For example, each computer 18, or one or more computers in a system of computers 18, may include software configured to utilize chosen input design components in a computer-implemented fashion game. The software may reside natively on each computer, be installed over a network connection or cable, or be stored on a removable media device (for example, a CD, a DVD, a flash memory, or any other appropriate memory) for loading into a computer when a user wishes to play a fashion game. The software implemented in computer 18 may include instructions which allow the computer to present a background image or environment on a computer-controlled display, and then to add the input design components to that environment so that a game may be played. For every input design component, the computer may add a component to the computer-controlled display.

Figure 12:
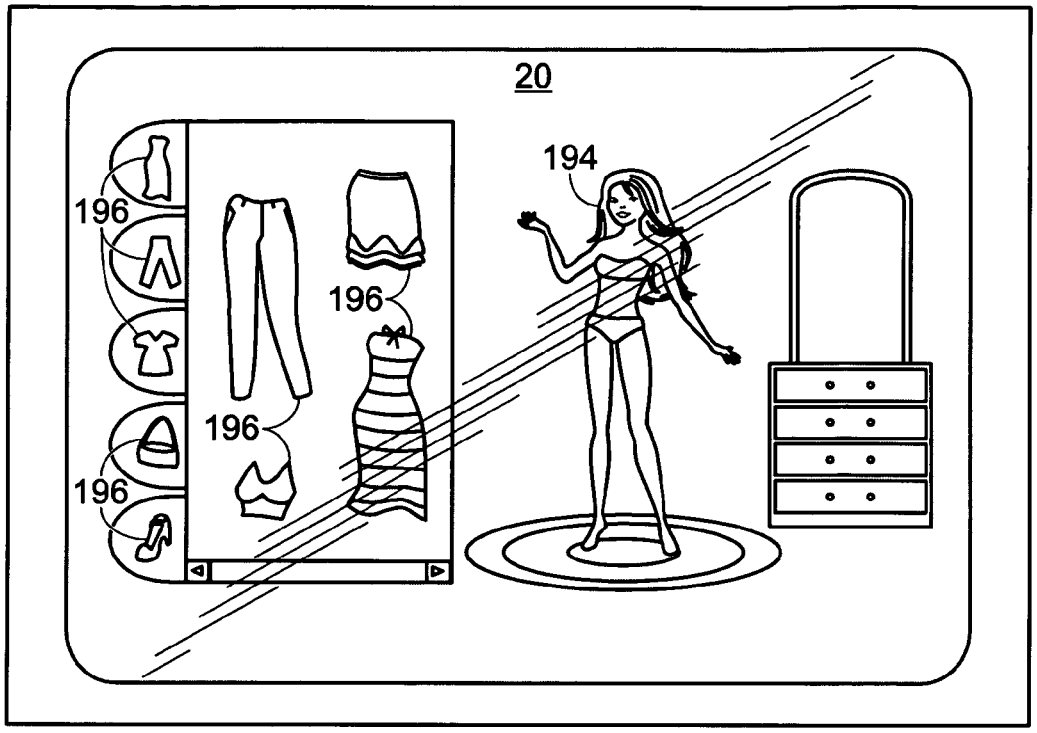
FIG. 12 shows a first exemplary screenshot from a computer-implemented fashion game.
Figure 13:
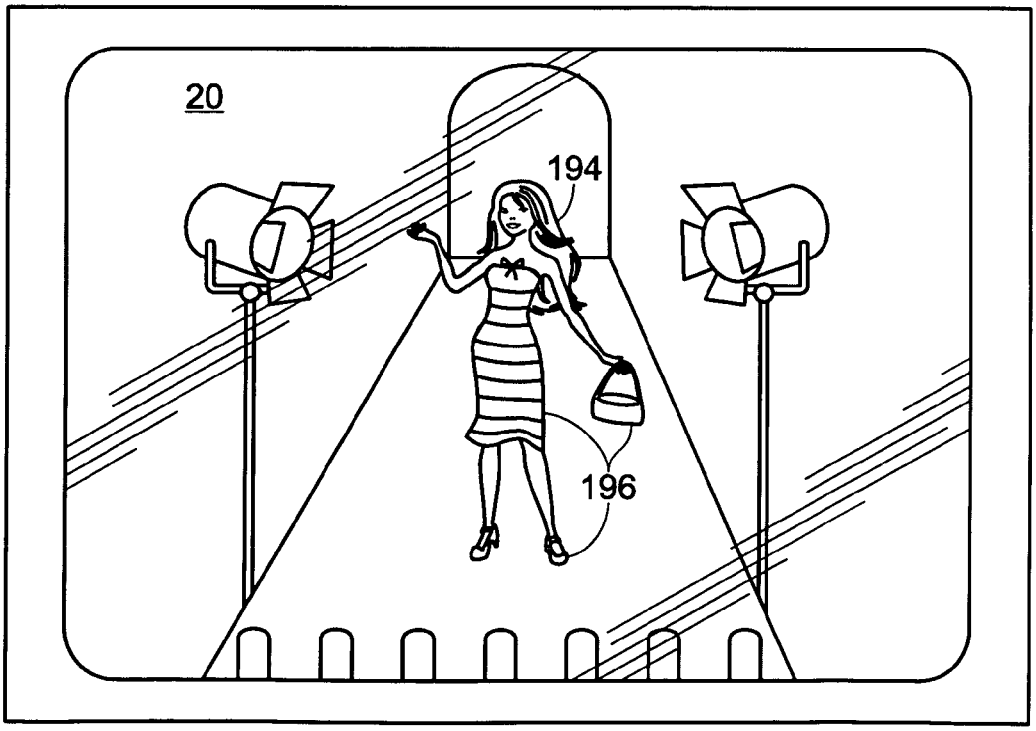
FIG. 13 shows a second exemplary screenshot from a computer-implemented fashion game.

FIGS. 12 and 13 show a pair of representative screenshots from a computer-implemented fashion game that may be played with the above-described game components. In the screenshots, a given play background 20 may include features providing a setting for a play experience using the scanned design components. For example, the background may be a runway fashion show, an outdoor environment (such as a beach, park, cityscape, etc.), an indoor environment, etc.

Alternatively, or in addition, a play background may be a model-building location or a dressing room in which a player designs an outfit from scratch and combines it with a model, or into which a game user scans outfit components for use in dressing a figure. For example, a user may be presented with a number of design components 196 that have appearances similar to, the same as, or somewhat different than opaque design components 24 present on a number of game cards 22.

As well, a user may be presented with one or more models 194 to be dressed or accessorized with design components 196. As noted above, individual members of each class of the elements noted (design components, models, backgrounds) may be input to the computing environment through a number of game cards with computer-readable codes (e.g. barcodes 52 scanned by card scanner 16).

Alternatively, or in addition, the software used in the computer 18 or computer system of multiple computers 18 may already include members of the classes of elements noted, such that they are implemented in the game environment in the absence of the scanning of cards. Additionally, a user could purchase or download additional class members as a way of supplementing the class members on a deck of cards or present in the computing environment.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances. The subject matter of the present invention includes all novel and non-obvious combinations and subcombinations of the various elements, features, functions and/or properties disclosed herein. Inventions embodied in various combinations and subcombinations of features, functions, elements, and/or properties may be claimed through presentation of claims in a subsequent application.

What is claimed is:

1. A method of playing a design game, the method comprising the steps of:

selecting a first card having a first opaque design component and a transparent portion;

selecting a second card having a second opaque design component and a transparent portion, wherein the opaque design component and transparent portion of each card are configured such that a layered configuration of the cards allows the opaque design component of the first card to be seen through the transparent portion of the second card;

scanning into a computing device a first design code from the first card, wherein the first design code corresponds to the first opaque design component;

scanning into the computing device a second design code from the second card, wherein the second design code corresponds to the second opaque design component; and displaying on a visual display device associated with the computing device at least the first and second opaque design components in response to scanning the first and second design codes.

2. The method of claim 1, wherein the steps of selecting the first and second cards are performed with a card compiler, the method of using the card compiler comprising:

holding a deck of cards at a first frame portion;

removing selectively, with a second frame portion movable relative to the first frame portion and a third frame portion, a card from a position in the deck of cards held at the first frame portion; and delivering, with the second frame portion, the selected card to a location near the third frame portion.

3. The method of claim 2, further comprising the step of returning the selected card to the first frame portion, wherein the step of returning the selected card includes returning the card to a different location within the deck of cards than the location from which the card was removed from the deck of cards.

4. The method of claim 2, further comprising the step of transferring the selected card from the second frame portion to the third frame portion.

5. The method of claim 1, wherein the step of scanning a design code includes scanning a bar code.

6. A game system, comprising:

a deck of cards, wherein each card includes an opaque design component and a transparent portion, wherein each card in the deck of cards includes a design code unique to that card, and wherein the opaque design component and transparent portion of each card are configured such that a layered plurality of the cards allows the opaque design component of a first card to be seen through the transparent portion of a second card;

a computer readable medium embodying computer-executable instructions for enabling a computer to perform a method comprising the steps of:

receiving the design code corresponding to the opaque design component from the first card; and displaying the opaque design component on a visual display device in response to receiving the design code; and a card compiler, wherein the card compiler is configured to compile selectively a subset of the deck of cards from the deck of cards.

7. The game system of claim 6, wherein the card compiler comprises:

a first frame portion configured to hold the deck of cards at a first location;

a second frame portion configured to hold a subset of the deck of cards at a second location; and a third frame portion, movable relative to the first frame portion and the second frame portion, wherein the third frame portion is configured to remove selectively a single card from a position in the deck of cards held at the first frame portion and deliver it to the second frame portion to form the subset of the deck of cards.

8. The card compiler of claim 7, further comprising a release mechanism configured selectively to transfer the card from the third frame portion to the second frame portion, wherein the third frame portion is configured to return a nontransferred card to the first frame portion.

9. The card compiler of claim 8, wherein the third frame portion returns the card to a position in the deck of cards that is different from the position from which it was removed.

10. A card compiler for use in a design game, comprising:

a housing including at least a first window and a second window;

a first frame portion configured to hold a deck of cards and removably positionable within the housing to display a top card of the deck of cards through a first one of the windows;

a second frame portion configured to hold a subset of the deck of cards and removably positionable within the housing to display the subset of the deck of cards through a second one of the windows; and a third frame portion, movably coupled to the housing and configured to move selectively a card from the deck of cards held by the first frame portion and deliver it to the second frame portion when the first and second frame portions are positioned within the housing.

11. The card compiler of claim 10, further comprising a release mechanism configured selectively to transfer the card from the third frame portion to the second frame portion, wherein the third frame portion is configured to return a nontransferred card to the first frame portion.

12. The card compiler of claim 11, wherein the third frame portion returns the card to a position in the deck of cards that is different from the position from which it was removed.

13. The card compiler of claim 10, wherein a card in the deck of cards includes a transparent portion and an opaque design component, wherein the card includes a design code unique to that card, and wherein the opaque design component and transparent portion of the card are configured such that a layered plurality of the cards allows the opaque design component of a first card to be seen through the transparent portion of a second card.

14. The card compiler of claim 13, wherein each design code includes a bar code.

15. The card compiler of claim 14, wherein each card further includes a combination code, wherein the deck of cards includes a plurality of classes of cards, wherein each card in a class of cards shares a similar combination code, and wherein the combination codes are configured to signify complementary combinations of the design components.

16. The card compiler of claim 10, wherein the second frame portion of the card compiler is configured to be removable from the card compiler, and wherein the second frame portion is configured to hold securely the subset of cards when the second frame portion is removed from the card compiler.

17. A method of using a card compiler comprising:

holding, via a first frame portion of the card compiler, a deck of cards;

removing selectively, via a second frame portion of the card compiler, a card from a position in the deck of cards held at the first frame portion, the second frame portion being moveable relative to the first frame portion and a third frame portion of the card compiler; and delivering, via the second frame portion, the selected card to a position in the card compiler near the third frame portion.

18. The method of claim 17, further comprising transferring, via the second frame portion, the selected card from the second frame portion to the third frame portion.

19. The method of claim 17, further comprising returning, via the second frame portion, the selected card to the deck of cards.

20. The method of claim 19, wherein returning the selected card includes returning, via the second frame portion, the selected card to a different location within the deck of cards than the location from which the card was removed from the deck of cards.

* * * * *